United States Patent [19]

Takabatake

[11] 4,123,829

[45] Nov. 7, 1978

[54] LOCKABLE SLIDERS

[75] Inventor: Hideo Takabatake, Kurobe, Japan

[73] Assignee: Yoshida Kogyo K.K., Japan

[21] Appl. No.: 827,606

[22] Filed: Aug. 25, 1977

[30] Foreign Application Priority Data

Sep. 2, 1976 [JP] Japan ..... 51-117869[U]

[51] Int. Cl.[2] ..... A44B 19/26; A44B 19/00

[52] U.S. Cl. ..... 24/205 R; 24/205.15 R; 24/205.11 L

[58] Field of Search ..... 24/205 R, 205.15 R, 24/205.11 L

[56] References Cited

U.S. PATENT DOCUMENTS

| | | | |
|---|---|---|---|
| 2,393,551 | 1/1946 | Morin | 24/205 R |
| 2,517,403 | 8/1950 | Morin | 24/205 R |
| 2,621,387 | 12/1952 | Williams | 24/205.15 R |

*Primary Examiner*—Bernard A. Gelak
*Attorney, Agent, or Firm*—Bucknam and Archer

[57] ABSTRACT

A pair of sliders to be arranged reversely to each other on a pair of fastener stringers so as to be padlocked together in abutting engagement with each other upon full closure of the fastener. Each slider has a forwardly projecting link portion formed on the front end of its body and having an eye formed transversely therethrough. On one of the side faces of the link portion there is formed a forwardly directed ledge extending radially or diametrically of the eye. Upon full closure of the fastener, the link portions of the two sliders interlock, with their opposed ledges in close contact with each other, to hold their eyes in axial alignment for the insertion of the padlock shackle. The link portion of each slider has its bottom end formed into a tongue which can be received in a groove formed in the body of the other slider.

5 Claims, 3 Drawing Figures

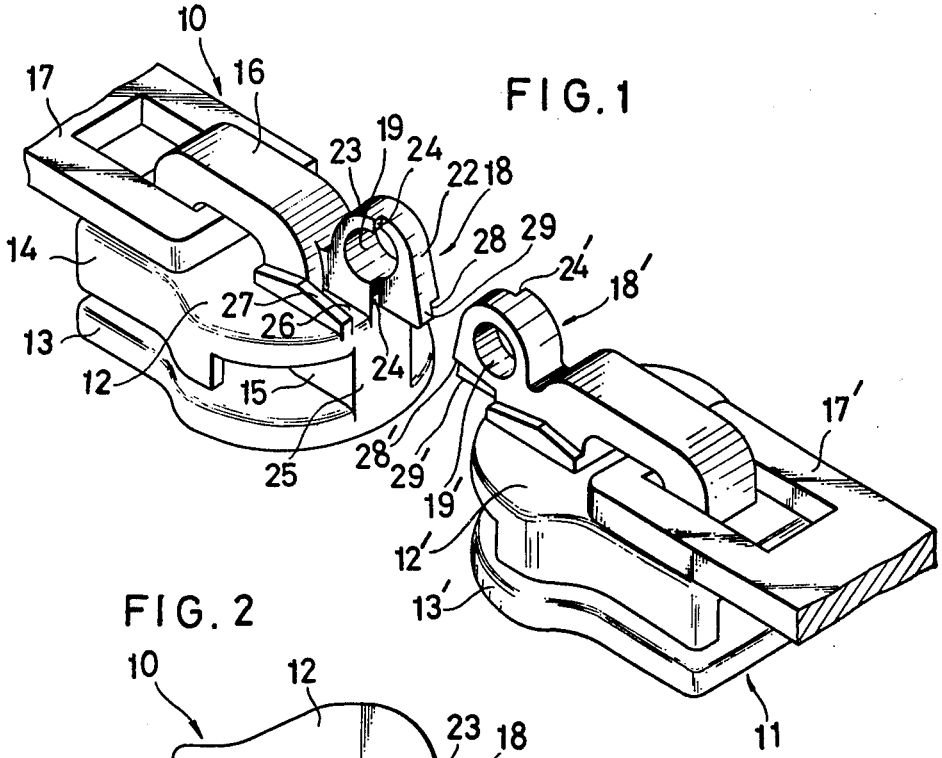
FIG. 1
FIG. 2
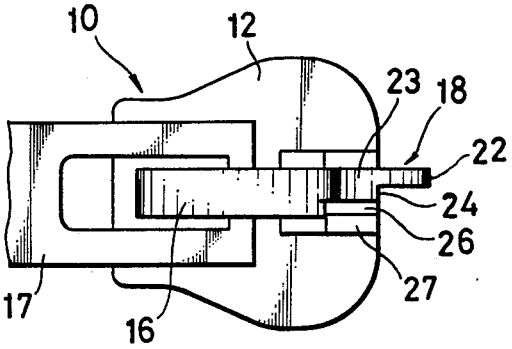
FIG. 3
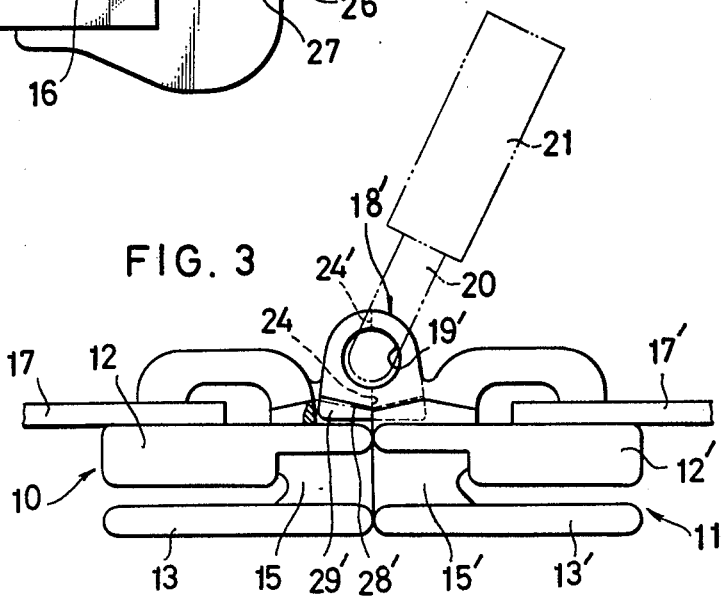

LOCKABLE SLIDERS

BACKGROUND OF THE INVENTION

1. Field of the Invention

This invention relates to slide fasteners, and more particularly to a slide fastener of the type comprising a pair of sliders arranged reversely with resepct to each other on a pair of fastener stringers so as to be fastened together by means of a padlock upon full closure of the fastener. Still more particularly, the invention is directed to the improved configuration of such a padlockable pair of fastener sliders.

2. Prior Art

A padlockable pair of sliders for slide fasteners usually has annular link portions formed on and projecting forwardly from the opposed front ends of their bodies, in such a way that when the sliders are moved into abutment against each other to close the fastener, their link portions assume a side-by-side disposition to permit the shackle of a padlock to be inserted into and through the transversely aligned eyes formed in the link portions. During this padlocking operation, the sliders tend to be swung in opposite directions about the padlock shackle extending through the eyes in their link portions, thereby partly opening the fastener.

In order to prevent such undersired swinging motion of the sliders, the link portion of each slider has heretofore been formed merely so as to abut against the top wing of the body of the other slider. This conventional measure is objectionable, however, in that the top wings of the slider bodies are highly susceptible to localized wear. The useful life of the sliders or of the slide fastener itself has therefore been not so long as it is expected to be.

SUMMARY OF THE INVENTION

It is an object of this invention to provide an improved slider for a slide fastener which can be padlocked together with another slider of identical construction upon full closure of the fastener, so made that the sliders will not suffer any rapid wear despite repeated padlocking operation.

Another object of the invention is to provide such a pair of fastener sliders which can be held stably interlocked to permit easy padlocking.

Another object of the invention is to provide such a pair of fastener sliders which can be interlocked for immediate padlocking simply be being pulled into abutment against each other.

Briefly, a fastener slide in accordance with this invention has a forwardly directed ledge which is formed on one of the side faces of a link formed on and projecting forwardly from the front end of the slider body and which extends radially of an eye formed transversely through the link. When this and another slider of identical construction are arranged reversely to each other on a pair of fastener stringers and are moved into abutment against each other to close the fastener, the two sliders interlock, with the opposed ledges of their links in close contact, to hold the eyes in the links in axial alignment with each other. The contacting ledges are effective to hold the sliders in positions relative to each other during the subsequent padlocking operation.

The above and other objects, features and advantages of this invention and the manner of attaining the will become more apparent, and the invention itself will best be understood, from the following description and the appended claims, taken together with the accompanying drawings showing a preferred embodiment of the invention.

BRIEF DESCRIPTION OF THE DRAWINGS

FIG. 1 is a perspective view of the padlockable pair of sliders for slide fasteners constructed in accordance with this invention, with the sliders being shown unlocked and separated away from each other;

FIG. 2 is a top plan view of one of the sliders of FIG. 1; and

FIG. 3 is a side elevational view of the pair of sliders of FIG. 1, with the sliders being shown interlocked and fastened together by means of a padlock.

DESCRIPTION OF THE PREFERRED EMBODIMENT

In the drawings, a padlockable pair of fastener sliders 10 and 11 in accordance with this invention are of identical construction. Only the slider 10, therefore, will be described in detail, and the reference numerals used to denote various parts of this slider will be simply primed to designate corresponding parts of the other slider 11, it being understood that the following description of the slider 10 is directly applicable to the other slider 11.

With particular reference to FIGS. 1 and 2, the slider 10 has a body comprising top and bottom wings or plate members 12 and 13, with the top wing having a pair of flanges 14 (one seen in FIG. 1) arranged along its marginal edges, and a neck 15 connecting the top and bottom wings at their flared front ends so as to be in parallel spaced relationship to each other. The usual Y-shaped guide channel is thus defined in the slider body. On the external surface of the top wing 12 of the slider body there is mounted a longitudinally extending lug 16 to which there is pivotally and slidably attached a pull tab 17 for manipulating the slider in the well known manner.

In accordance with this invention, there is integrally formed on the front end of the top wing 12 of the slider body a link 18 of substantially annular shape having an eye 19 formed transversely therethrough for loosely receiving the shackle 20 of a conventional padlock 21 shown in FIG. 3. Approximately one half 22 of the link 18 projects forwardly beyond the front end of the slider body, whereas the other half 23 of the link overlies the slider body.

As will be best seen from FIG. 2, the link 18 as a whole lies slightly closer to one side of the slider body (disposed upwardly as viewed in FIG. 2) than to the other side thereof. It will also be noted that the front half 22 of the link 18 is made less in thickness than its rear half 23, in order to provide a forwardly directed ledge 24 on that face of the link which is directed toward said other side of the slider body (downwardly as viewed in FIG. 2).

The ledge 24 is disposed in the same plane as the front surface 25 of the slider body neck 15. Further, the ledge 24 extends radially or diametrically of the eye 19 in the link 18 and is thereby divided into upper and lower portions as shown. If desired, only one such ledge portion may be formed either over or under the eye 19, although the illustrated shape of the link 18 is far preferable.

Also formed in the top wing 12 of the slider body is a groove 20 which is located on the ledged side of the link 18 and which extends along its rear half 23. In the illustrated embodiment, the groove 26 is defined by and between the rear half 23 of the link 18 and a ridge 27 formed integrally on the top wing 12 of the slider body. The ridge 27 gradually increases in height as it extends rearwardly from the front end of the slider body top wing 12 to the front end of the lug 16 thereon.

The link 18 has a recess 28 formed in the bottom end portion of that face thereof which is directed toward said one side of the slider body. The recess 28 is shaped and sized to suit the shape and size of the ridge 27. By this recess 28 is the bottom end portion of the link 18 formed into a tongue 29 to fit into the groove 26' (not seen in the drawings) of the other slider 11.

The fastener slider 10 in accordance with this invention being constructed as in the foregoing, and the other slider 11 being of identical construction, the links 18 and 18' of the sliders 10 and 11 interlock as shown in FIG. 3 when the two sliders are arranged reversely with respect to each other on a pair of fastener stringers, not shown, and moved forwardly into abutment against each other to close the slide fastener. The ledges 24 and 24' of the interlocking lines 18 and 18' are in close contact with each other, and their eyes 19 and 19' are in axial alignment in the transverse direction of the sliders 10 and 11.

Furthermore, upon abutment of the sliders 10 and 11 against each other as above, the tongues 29 and 29' at the bottom ends of their links 18 and 18' are relatively closely received in the grooves 26' (not seen) and 26, and the ridges 27 and 27' (not seen) on the top wings 12 and 12' of the sliders are also relatively closely received in the recesses 28' and 28 in the links 18' and 18, respectively. The sliders 10 and 11 can thus be prevented from swinging motion with respect to each other in the plane of the unshown fastener stringers.

For locking together the abutting pair of sliders 10 and 11, the shackle 20 of the padlock 21 may be inserted into and through the aligned eyes 19 and 19' in the links 18 and 18' and may then be closed in the usual manner. Even if, during this padlocking operation, either or both of the sliders 10 and 11 are subjected to forces tending to swing same about the aligned axes of the eyes 19 and 19', the sliders can be effectively restrained from such swinging motion by the contacting ledges 24 and 24' of their interlocking links 18 and 18'.

Since the ledges 24 and 24' are disposed radially or diametrically of the eyes 19 and 19', the forces applied thereto as above are substantially perpendicular to their surfaces, so that the ledges will not easily slide with respect to each other. Further, since the forces are sustantially equally distributed over the entire surfaces of the ledges, they will not suffer uneven wear. The useful life of the pair of fastener sliders 10 and 11 is thus markedly increased. It is also noteworthy that the sliders 10 and 11 can be interlocked merely by being pulled into abutment against each other, thereby permitting immediate padlocking. From the foregoing description and the drawings, the artisan will appreciate that the invention provides a slider 10, 11, which is disposed to be locked together with an oppositely facing similar slider on the same slide fastener, using a locking means, such as a padlock 21, or other type (not shown) that can extend through the aligned eyes 19, 19' of the two opposed sliders 10,11.

On the typical slider 10, 11 there is provided a respective link 18, 18' carried by one of the wings of the slider and having an eye 19, 19' extending transversely through the link 18, 18' to accommodate the insertion of the locking means. Each link 18, 18' has on one side a ledge 24, 24', extending radially of the eye 19, 19', and such ledge 24, 24' is positioned for an abutment with the ledge 24', 24 of the similar slider 11, 10, to position the eyes 19, 19' of both sliders 10, 11, in alignment to receive through both eyes 19, 19', the locking means and also to prevent pivotal movement of the sliders 10, 11, relative to each other when so locked together by the locking means received through said eyes 19, 19'.

While the present invention has been shown and described in terms of a preferable embodiment thereof, it is understood that this embodiment is merely for the purpose of illustration and explanation and is not to impose limitations upon the invention. Various modifications and variations may be devised without departing from the spirit or scope of this invention as expressed in the following claims.

What is claimed is:

1. A slider for a slide fastener which slider is disposed to be locked together with an oppositely facing similar slider on the same slider fastener, which slider comprises:

(a) a body having a pair of wings connected to each other at corresponding ends by a neck to define a Y-shaped guide channel therebetween for passage therethrough of fastener element rows of the slide fastener;

(b) a link carried by one of said wings and having an eye extending transversely through the link to accommodate the insertion of a locking means, said link extending beyond the end of said slider and generally parallel to the longitudinal axis of said slider, said link having on one side a ledge extending radially of said eye generally perpendicular to said one wing, said ledge being positioned for abutment with the ledge of said similar slider to position the eyes of both sliders in alignment to receive through both eyes said locking means and to prevent pivotal movement of said sliders relative to each other when locked together by said locking means received through said both eyes.

2. A slider as recited in claim 1, wherein the ledge of the link has an abutment surface disposed in the same plane as a front surface of the neck of the body.

3. A slider as recited in claim 1, wherein a top wing of the body has a groove disposed for receiving a bottom end portion of the link of said similar slider.

4. A slider as recited in claim 3, wherein the top wing of the body has a ridge defining said groove between the ridge itself and the link, and wherein the link has a recess formed in said bottom end portion disposed for receiving the ridge on the body of said similar slider.

5. A slider as recited in claim 4, wherein said ridge increases in height as it extends rearwardly from a front end of the body, and wherein said recess in the link is shaped correspondingly to receive the ridge on the body of said similar slider.

* * * * *